US008342829B2

(12) United States Patent
Achtelik et al.

(10) Patent No.: US 8,342,829 B2
(45) Date of Patent: Jan. 1, 2013

(54) THREE-STAGE SCREW COMPRESSOR

(75) Inventors: Carsten Achtelik, Dinslaken (DE); Dieter Hüttermann, Hünxe (DE); Michael Besseling, Hünxe (DE); Norbert Henning, Mülheim (DE); Jürgen Bringmann, Oberhausen (DE); Robert L. Oppenheim, Novi, MI (US)

(73) Assignee: GHH Rand Schraubenkompressoren GmbH, Oberhausen (DE)

( * ) Notice: Subject to any disclaimer, the term of this patent is extended or adjusted under 35 U.S.C. 154(b) by 889 days.

(21) Appl. No.: 12/094,390

(22) PCT Filed: Jun. 9, 2006

(86) PCT No.: PCT/EP2006/005558

§ 371 (c)(1),
(2), (4) Date: May 12, 2009

(87) PCT Pub. No.: WO2007/065486

PCT Pub. Date: Jun. 14, 2007

(65) Prior Publication Data

US 2009/0246054 A1 Oct. 1, 2009

(51) Int. Cl.

| | |
|---|---|
| ***F01C 1/16*** | (2006.01) |
| ***F01C 1/24*** | (2006.01) |
| ***F01C 11/00*** | (2006.01) |
| ***F04C 2/16*** | (2006.01) |
| ***F04C 2/24*** | (2006.01) |
| ***F04C 23/00*** | (2006.01) |

(52) U.S. Cl. ..... 418/201.1; 418/9

(58) Field of Classification Search ..... 418/201.1, 418/9

See application file for complete search history.

(56) References Cited

U.S. PATENT DOCUMENTS

| | | | | |
|---|---|---|---|---|
| 2,849,988 A | | 9/1958 | Nilsson | |
| 3,138,320 A | | 6/1964 | Schibbye et al. | |
| 3,184,155 A | * | 5/1965 | Crooks | 418/9 |
| 3,407,996 A | | 10/1968 | Olofsson et al. | |
| 4,076,468 A | | 2/1978 | Persson et al. | |
| 4,487,563 A | | 12/1984 | Mori et al. | |

(Continued)

FOREIGN PATENT DOCUMENTS

DE 1147443 B 4/1963

(Continued)

*Primary Examiner* — Mary A Davis
(74) *Attorney, Agent, or Firm* — Michael Best & Friedrich LLP

(57) ABSTRACT

The invention relates to a multi step helical screw compressor unit which consists of a drive housing (90), wherein a first, second, and third helical screw compressor (60, 70, 80) are secured in a protruding manner parallel to each other and are driven together by a drive toothed wheel in the drive housing. A gas-like fluid is compressed by the first helical screw compressor (60) at a first intermediate pressure of approximately 3.5 bars, by the second helical screw compressor (70) at a second intermediate pressure of approximately 12 bars and by the third helical screw compressor (80) at an end pressure of approximately 40 bars. The driven toothed wheels (65, 75) of the first and the second helical screw compressors are in contact with the drive toothed wheel (95) above the axes thereof, when the driven toothed wheel (85) of the third helical screw compressor (80) is in contact with the drive toothed wheel (95) in the vicinity of the deepest point thereof (T). The position of the axis of the drive toothed wheel (95) can be modified horizontally, and the position of the driven toothed wheel (85) of the third helical compressor (80) can be modified vertically, in order to install a wheel set having various diameter ratios.

11 Claims, 5 Drawing Sheets

U.S. PATENT DOCUMENTS

| | | | | |
|---|---|---|---|---|
| 4,767,284 | A | | 8/1988 | Shiinoki et al. |
| 4,781,553 | A | | 11/1988 | Nomura et al. |
| 4,984,974 | A | | 1/1991 | Naya et al. |
| 5,382,132 | A | * | 1/1995 | Mendel ..... 415/60 |
| 5,836,753 | A | | 11/1998 | Takei et al. |
| 6,287,100 | B1 | | 9/2001 | Achtelik et al. |
| 6,416,302 | B1 | | 7/2002 | Achtelik et al. |
| 6,478,560 | B1 | | 11/2002 | Bowman |
| 6,572,354 | B2 | | 6/2003 | Kammhoff et al. |
| 2002/0081213 | A1 | | 6/2002 | Takahashi et al. |

FOREIGN PATENT DOCUMENTS

| | | | |
|---|---|---|---|
| DE | 29922878 | U1 | 5/2001 |
| EP | 0582185 | A | 2/1994 |
| JP | 11223181 | A | 8/1999 |

* cited by examiner

THREE-STAGE SCREW COMPRESSOR

RELATED APPLICATION DATA

This application claims priority from German Patent Application No. 10 2005 058 698.8, filed Dec. 8, 2005, and PCT Application No. PCT/EP2006/005558, filed Jun. 9, 2006, both of which are incorporated by reference herein.

BACKGROUND

The invention pertains to a multi-stage screw compressor system. Preferably, the screw compressor system is a "dry-running" system for high pressures, typically 40 bar and above. A preferred area of applicability is the production of compressed air for blow-molding of plastic bottles.

A two-stage screw compressor system is known from U.S. Pat. No. 3,407,996 (corresponding to DE-A-1628201). It has a gearbox with a perpendicular mounting wall, attached to which are two adjacent compressor stages that cantilever parallel with one another. Each compressor stage comprises a screw compressor with two mutually engaging screw rotors. Located in the gearbox is a transmission with a drive gear that meshes with two driven gears that rotate the rotors of the two screw compressors. Also disclosed in the document is that the invention described in it can also be used in multistage compressor systems with more than two stages. However, there is no indication of how further compressor stages can be arranged, and the design that is described in detail has no place for further compressor stages.

A similar two-stage screw compressor system is also known from DE 299 22 878.9 U1.

The object of the invention is to design a three-stage screw compressor system that can deliver a compressed gaseous fluid, in particular compressed air, at a very high pressure, typically about 40 bar and above, and that is characterized by its space-saving design, its simplicity and robustness. In another embodiment of the invention, the three-stage screw compressor system according to the invention allows the ratio of the RPM's of the three compressor stages to be changed in a simple manner.

To meet this objective, a three stage screw compressor is provided with the features according to claim 1 according to the invention. The dependent claims refer to further advantageous features of the invention.

The screw compressor system according to the invention can compress gaseous fluid, in particular air, to a very high pressure ratio, for example 40:1, using only three compressor stages; thus, compressed air can be supplied at a high pressure as is required for industrial manufacturing processes such as blow-molding of plastic bottles.

In the screw compressor system according to the invention, the screw compressors that constitute the first and second stages are located above the horizontal plane that runs through the rotating axis of the drive gear, whereas the screw compressor of the third stage is located below the screw compressors of the first and second stages and below the horizontal plane running through the rotating axis of the drive gear, and whereas its driven gear meshes with the drive gear near its lowest point. This results in an especially advantageous utilization of the existing space configurations and thus a space-saving, compact design of the compressor system. By using different exchangeable bearings and flange parts, the position of the drive shaft can be changed in the horizontal direction and the position of the third compressor stage can be changed in the vertical direction in order to adjust the gearing configuration to different diameters of gears and thus to different RPM ratios of the compressor stages.

SUMMARY

In one construction, the invention provides a multi-staged screw compressor system with a gearbox (90), a drive gear (95) located in the gearbox, and a first, second and third screw compressor (60, 70, 80) that are fastened to the gearbox and coupled to the drive gear such that they are all driven in common by the drive gear. During operation, the first screw compressor (60) compresses a flow of gaseous fluid from an inlet pressure to a first intermediate pressure, the second screw compressor (70) compresses the flow of fluid from the first intermediate pressure to a second intermediate pressure, and the third screw compressor compresses the flow of fluid from the second intermediate pressure to a final pressure, wherein the final pressure is at least thirty times, preferably at least forty times the inlet pressure.

BRIEF DESCRIPTION OF THE DRAWINGS

One embodiment of the invention is explained in more detail with the help of the drawings. Shown are.

DETAILED DESCRIPTION

Figure 1:
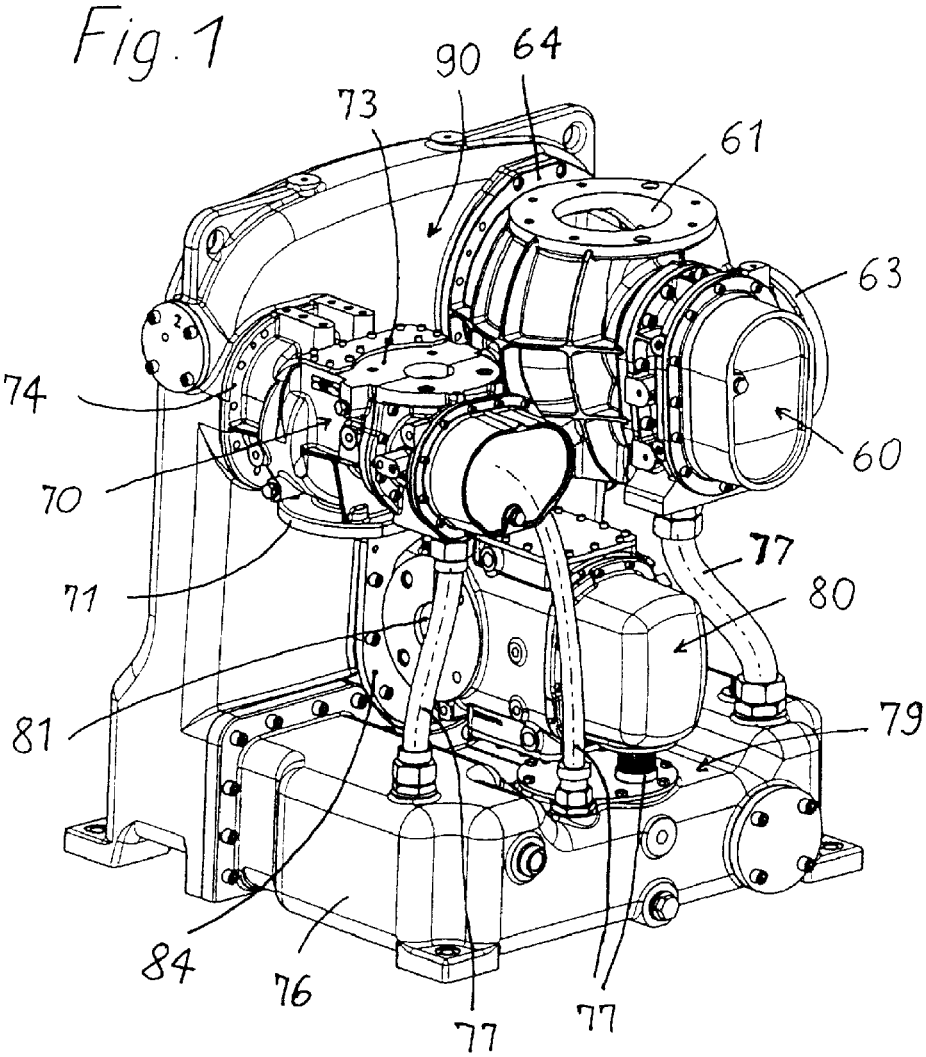
FIG. 1 a perspective view of three-stage compressor system according to an embodiment of the invention.

FIG. 1 shows a perspective view of a three-stage screw compressor system with three screw compressors 60, 70, 80 that are attached to a gearbox 90 via flanges, said gearbox having essentially the shape of a perpendicular plate, and said screw compressors cantilevered parallel to one another. To accomplish this, the housing of each screw compressor 60, 70, 80 has a flange 64, 74 and 84 at its end facing the gearbox 90, said flange being connected to an associated mating flange on the gearbox 90. The three screw compressors 60, 70, 80 are driven by a common motor-driven drive gear held in the gearbox 90; this arrangement will be explained in more detail below. In the compressor system shown, screw compressor 60 is the initial stage (low pressure stage), with inlet opening 61 and outlet opening 63, screw compressor 70 is the second or intermediate stage with inlet opening 71 and outlet opening 73, and screw compressor 80 is the final stage (or high pressure stage) with inlet opening 81 and an outlet opening on the side opposite the inlet opening 81 that is not shown in FIG. 1. FIG. 1 also shows an oil sump housing 76 that is flanged to the base of the gearbox 90 and that is connected to the synchronizing gears of screw compressors 60, 70, 80 and to the drive gear located in the gearbox 90.

Not shown in FIG. 1 are the connection lines for the medium to be compressed, in particular air, which connect the inlets and outlets of the three screw compressors 60, 70, 80. These lines are designed in a manner known to those trained in the art and can be equipped with filters, intercoolers, and/or mufflers, for example.

The screw compressors 60, 70 of the first and second stage are located next to one another horizontally, whereas screw compressor 80, the third stage, is located beneath the screw compressors of the first and second stage. The oil sump housing 76 has a recess 79 on its upper surface that creates additional space with which to hold the screw compressor of the third stage.

Each of the three screw compressors 60, 70, 80 of FIG. 1 has two rotors, in the usual fashion, that are rotatably held in a rotor housing with parallel axes and that mesh with one another with screw-shaped ribs and grooves. For example, FIG. 2 shows screw compressor 80, which constitutes the third stage of the three-stage compressor system of FIG. 1, said compressor being especially designed for high pressures of preferably about 40 bar and above.

Figure 2:
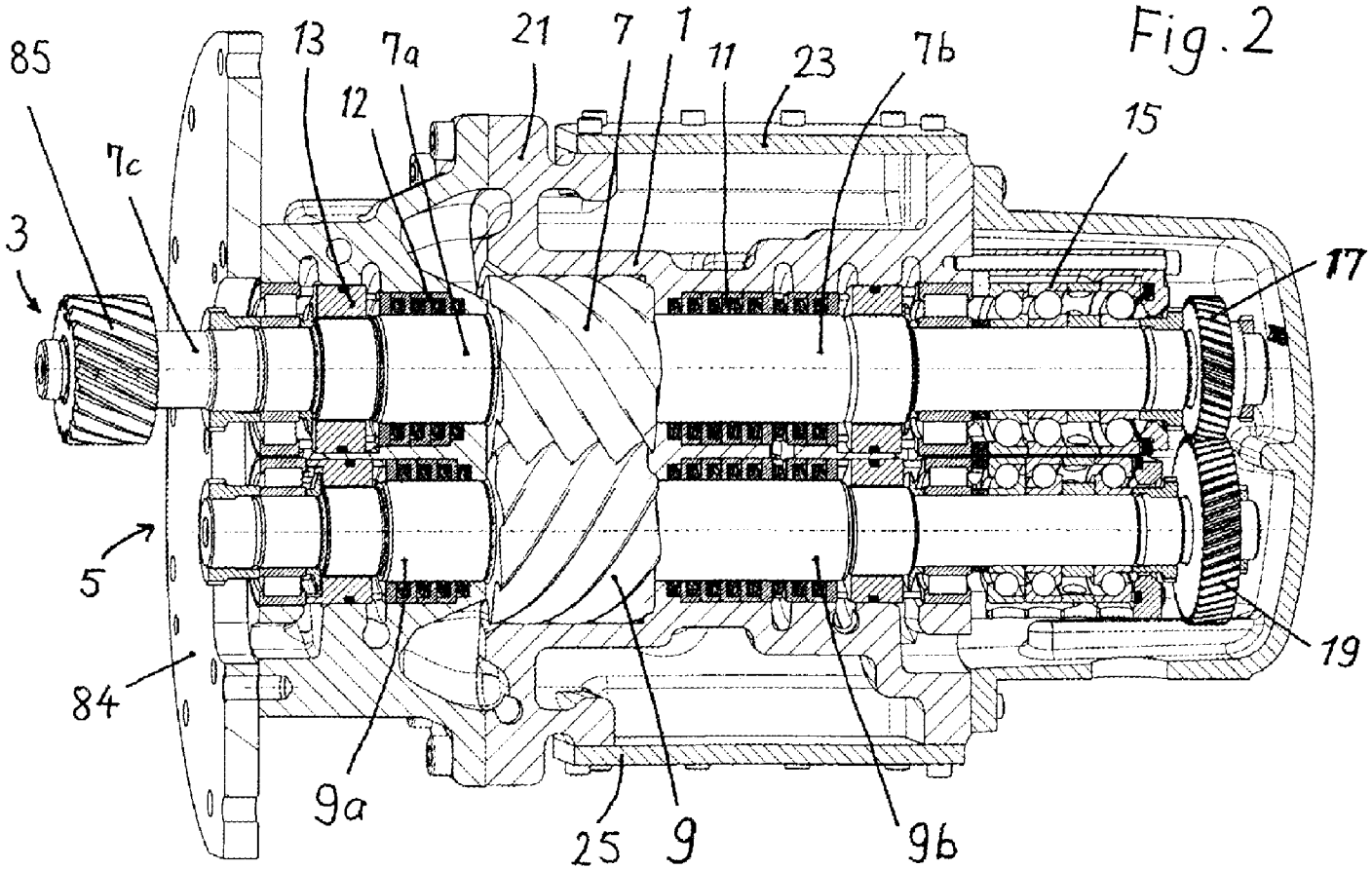
FIG. 2 a perspective, partial sectional view of the screw compressor that constitutes the third stage of the compressor system according to FIG. 1.

The screw compressor shown in FIG. 2 has a rotor housing 1 (shown in a longitudinal section) in which two rotors 3 and 5 are rotatably held with parallel axes. The rotating axes of the rotors 3, 5 lie in a common vertical plane. Each rotor 3, 5 has a profile section 7 and 9 with a profile that contains screw-shaped ribs and grooves, wherein the ribs and grooves of the two profile sections 7, 9 mesh with one another to form a seal. On both sides of the profile sections 7, 9 are shaft pins 7*a*, 7*b*, 9*a*, 9*b*, the surfaces of which cooperate with seal arrangements 11, 12 to seal the rotor in the rotor housing 1. The shaft pins 7*a*, 7*b*, 9*a*, 9*b* are also rotatably held in the rotor housing 1 with bearings 13, 15.

The upper rotor 3 in FIG. 2 is the main rotor, at the left end of which in FIG. 2 is an extended shaft pin 7*c* that extends into the gearbox 90 (FIG. 1) and supports a gear 85 that meshes with a drive gear in the gearbox in order to turn the rotor 3. At the right end in FIG. 2, the two rotors 3, 5 have two gears 17, 19 that mesh with one another, thus forming a synchronization unit (synchronizing transmission) that conveys the rotation of the upper rotor 3 to the lower rotor 5, which is the secondary rotor, at the desired RPM ratio; this ensures that the profile sections 7, 9 of the rotors 3, 5 mesh with one another without touching.

Rotor housing 1 is surrounding by a cooling jacket or cooling housing 21, which is for the most part designed as one-piece together with rotor housing 1, surrounding the same at a distance. Above and below, the cooling housing 21 has large openings that are closed off using a cover plate 23 and a base plate 25 fastened with bolts. Between the rotor housing 1 and the cooling housing 21, 23, 25 is an annular cooling space 27 surrounding the rotor housing 1 in which a liquid coolant circulates, such as water.

The screw compressor of the third stage shown in FIG. 2 is a "dry-rotor" similar to the screw compressors 60, 70 of the first and second stage; in other words its compression chamber is kept free of oil. Oil from the oil sump 76, which is circulated using an oil pump (not shown), is only used to lubricate the drive gear (gears 65, 75, 85, 95) and bearings 13, 15 as well as the synchronizing transmission (17, 19) of each screw compressor 60, 70, 80 (see 17, 19 in FIG. 2); however, the oil does not enter the compression chamber of the screw compressors.

At the left end of rotor housing 1 in FIG. 2 is a flange plate 84 that is removably attached using bolts, said plate serving to fasten the screw compressor to the mounting wall 91 of the gearbox. For this purpose, the flange plate 84 contains holes for attachment bolts. By replacing the flange plate 84 with a plate with another hole pattern, the position at which the screw compressor is fastened to the gearbox 90 can be changed.

In operating the compressor system shown in FIG. 1, air drawn in at inlet 61 of the first compressor stage 60 is compressed by it to a pressure in the range of 3 to 6 bar, preferably about 3.5 bar, and is then compressed to an intermediate pressure in the range of 10 to 15 bar, preferably about 12 bar, by the second compressor stage 70. This pre-compressed air goes from outlet 73 of the second stage 70 through a connecting line (not shown) to inlet 81 of the third compressor stage 80, where it is compressed to a final pressure in the range of 30 to 50 bar, preferably about 40 bar.

At the preferred operating pressures cited above, the pressure ratios in each of the three screw compressors 60, 70, 80 are nearly the same and decrease only minimally from the first to the third stage. At the pressures cited, the pressure ratio between the inlet ant outlet pressures in the first screw compressor 60 is approximately 3.5, in the second screw compressor 70 it is approximately 3.4 and in the third screw compressor 80 it is approximately 3.3.

Figure 3:
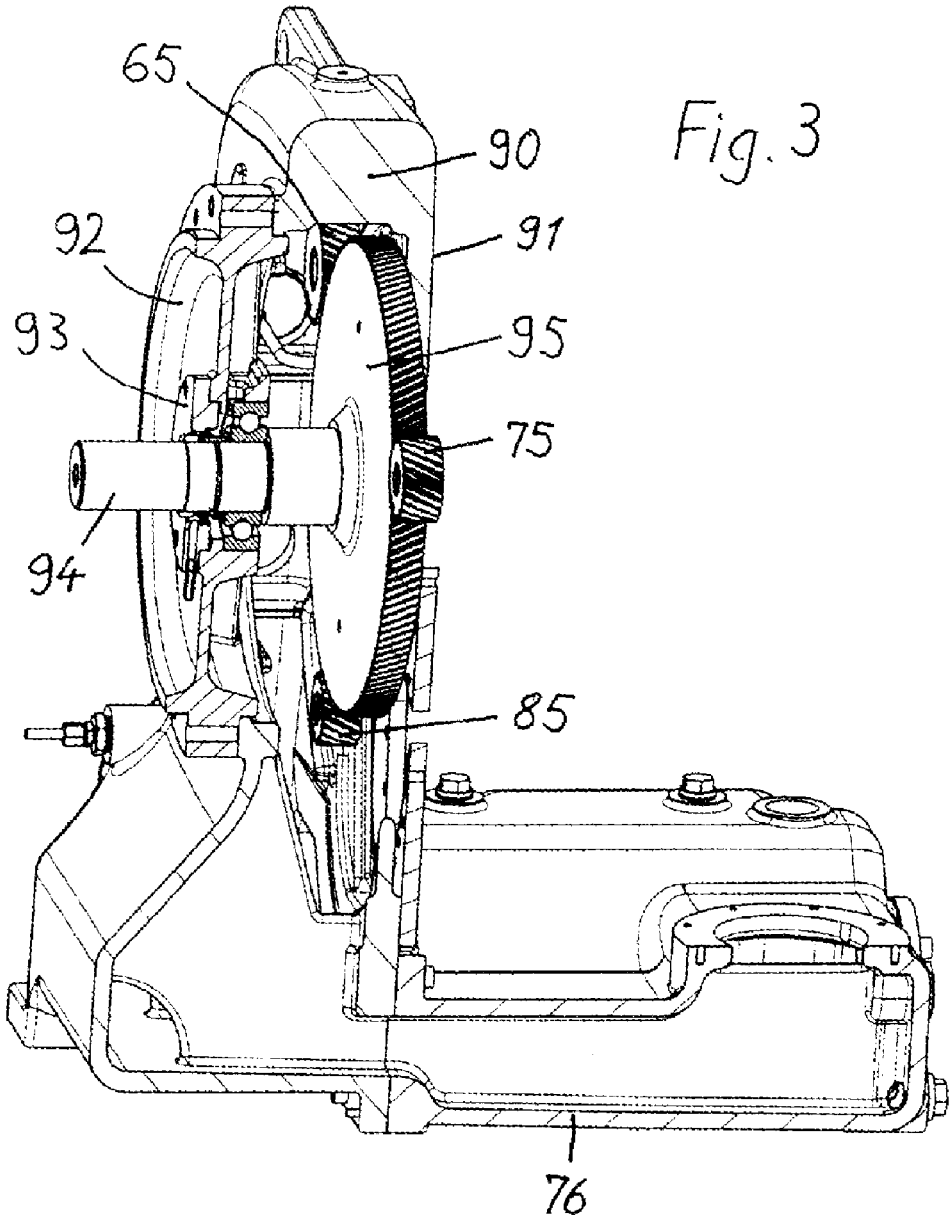
FIG. 3 a perspective, partial sectional view of the gearbox and transmission of the compressor system according to FIG. 1, with the compressor stages left out.

FIG. 3 shows a perspective view, in part sectional, of the gearbox 90 with the transmission contained therein to drive the three screw compressors 60, 70, 80. The gearbox 90 has a perpendicular mounting wall 91 on one side, to which the housings of the three screw compressors 60, 70, 80 (not shown in FIG. 3) are attached. On the other side, the gearbox 90 is closed off by a bearing cover 92 inside of which is a drive shaft 94 held by means of a bearing ring 93 and supporting a drive gear 95. The end of the drive shaft 94 that extends beyond the drive gear 95 is held in a bearing seat (see FIG. 5) that is set into the mounting wall 91. The drive gear 95 meshes with the three driven gears 65, 75, 85 associated with the three screw compressors 60, 70, 80, said driven gears being distributed about the perimeter of the drive gear 95. Each of the driven gears 65, 75, 85 sits on a rotor shaft pin of one of the three screw compressors 60, 70, 80, said pin protruding into the gearbox 90 through a corresponding hole in the mounting wall 91.

Figure 4:
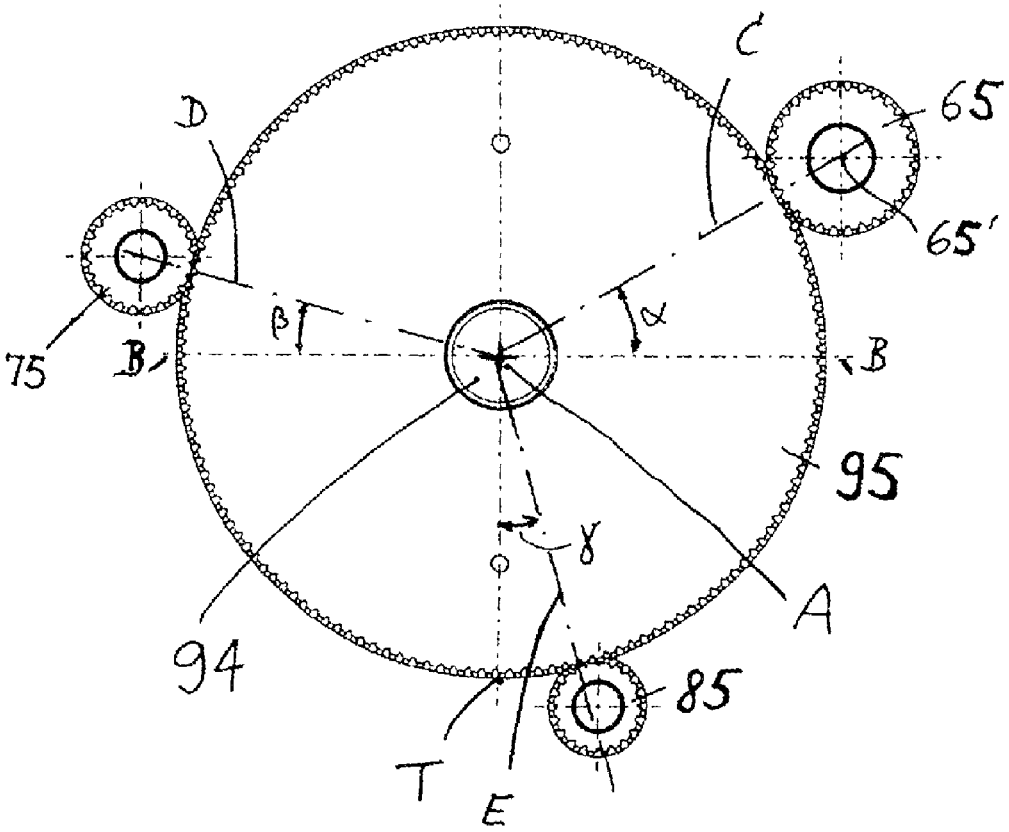
FIG. 4 a simplified representation of the gears that make up the transmission of the compressor system.

In FIG. 4, the arrangement of the three drive gears 65, 75, 85 is shown in relation to the drive gear 95. The driven gears 65, 75 of screw compressors 60 or 70 of the first and second stage are located above the horizontal plane B-B that runs through the rotating axis A of the drive gear 95. On the other hand, the driven gear 85 of screw compressor 80 of the third stage is clearly below the horizontal plane B-B running through axis A, preferably near the lowest point T of the drive gear 95. It is preferable to locate drive [sic] gear 65 for the first compressor stage such that a line C connecting its axis 65' to axis A of the drive gear 95 assumes an angle $\alpha$ of not more than 30° with respect to the horizontal line B-B running through axis A of the drive gear 95. For driven gear 75 of the second compressor stage 70, the corresponding angle $\beta$ is preferred not to be more than 20°. On the other hand, driven gear 85 of the third compressor stage 80 is located close enough to the lowest point T of the drive shaft 95 such that a line D [sic] connecting the axis of the driven gear 85 with the rotating axis A of the drive gear 95 assumes an angle $\gamma$ of not more than 20° with respect to the vertical plane running through the axis A of the drive gear 95.

Figure 5:
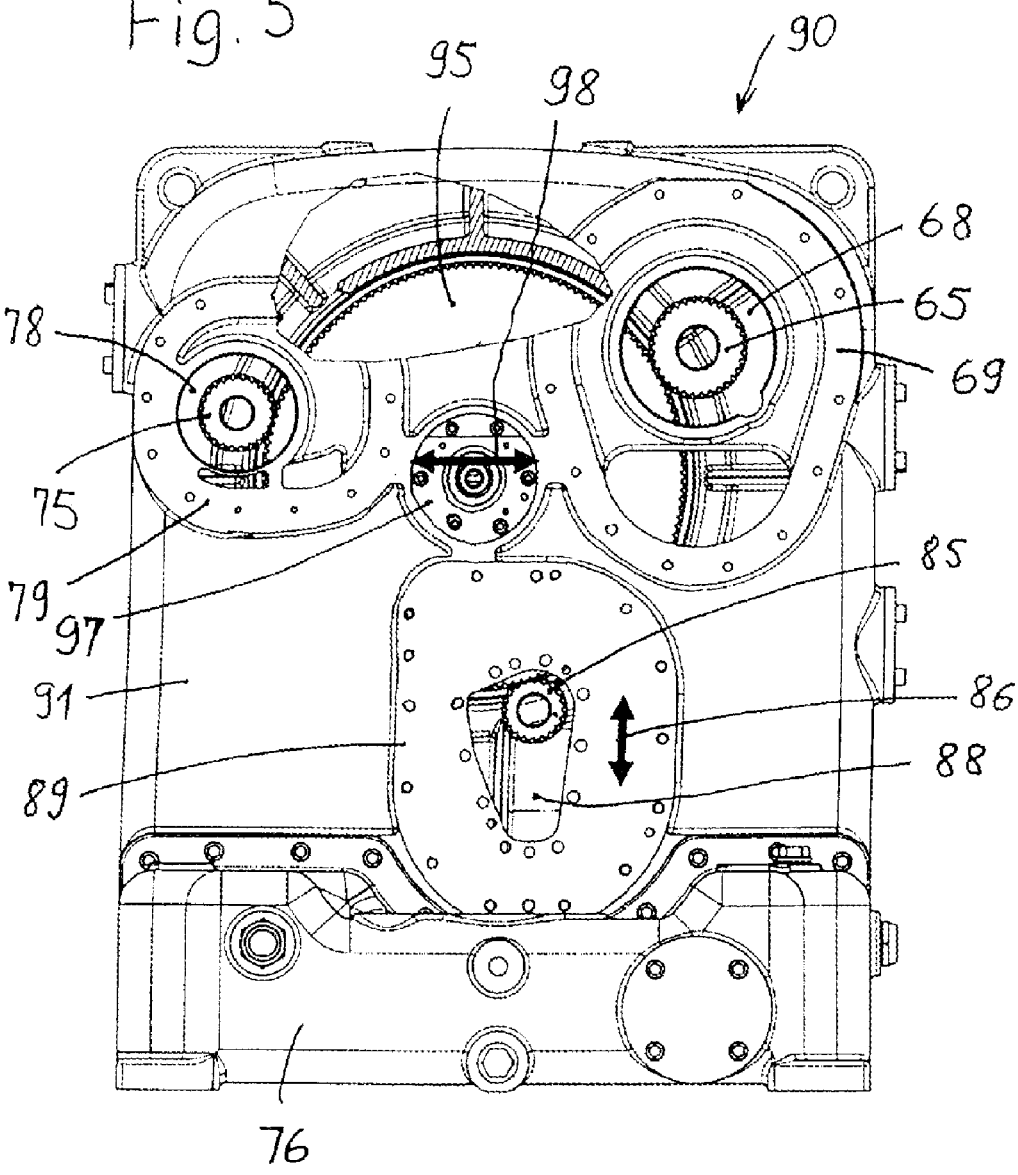
FIG. 5 a view of the mounting wall of the gearbox, partially removed in order to make the transmission visible.

FIG. 5 shows a view of the mounting wall 91 of the gearbox 90. This view is shown with a cutout in the upper area in order to show the drive gear 95 located behind the wall, said gear engaging with the driven gears 65, 75, 85 of the three screw compressors 60, 70, 80 (left out in FIG. 5). The mounting wall 91 has openings 68, 78, 88 through which the shaft pins (see 7*b* in FIG. 2) of the screw compressors 60, 70, 80 that support the gears 65, 75, 85 can pass into the gearbox 90. The mounting wall 91 has rib-like raised mating flanges 69, 79, 89 that surround openings 68, 78, 88. Flanges 64, 74, 84 of the compressors 60, 70, 80 (see FIG. 1) are fastened to these mating flanges with bolts and suitable gaskets.

A bearing seat 97 is set into the mounting wall 91 of the gearbox 90. The end of the drive shaft 94 (see FIG. 3) supporting the drive gear 95 is held in this bearing seat. Both the bearing seat 97 and the bearing ring 93 shown in FIG. 3 to hold the drive shaft 94 are eccentrically designed. By exchanging the bearing ring 93 and the bearing seat 97 with others having varying eccentricities, the position of the drive gear 95 can be changed in the horizontal direction, as indicated with the horizontal double arrow 98 in FIG. 5.

Furthermore, the flange plate 84 of screw compressor 80 that constitutes the third stage is removably bolted to the mating flange 89 of the gearbox, along with the rotor housing associated with it. This flange plate can be exchanged with a flange plate having a different hole pattern, which allows the position of the screw compressor 80 and thus its driven gear 85 to change in the vertical direction as indicated by the vertical double arrow 86 in FIG. 5.

This ability to shift the drive gear 95 in the horizontal direction 98 and to shift the driven gear of the third stage in the vertical direction 86 enables the use of different gear sets for gears 95, 65, 75 85 that make up the transmission, whereupon the gear ratios and thus the relative RPM's of the three compressor stages 60, 70, 80 can be changed by using different diameters matched with one another. In the process, all four gears 65, 75, 85, 95 that make up the transmission can be exchanged with such other diameters, wherein a shift of only two of these elements in two directions perpendicular to one another is sufficient, namely the drive gear 95 in the horizontal direction 98 and the gear 85 of the third stage in the vertical direction 86, to ensure proper meshing of the gears even when the diameter ratios are changed.

PARTS LIST

1 Rotor housing
3 Rotor
5 Rotor
7 Profile section
7*a* Shaft pin
7*b* Shaft pin
7*c* Shaft pin
9 Profile section
9*a* Shaft pin
9*b* Shaft pin
11 Sealing arrangement
12 Sealing arrangement
13 Bearing
15 Bearing
17 Gear
19 Gear
21 Cooling jacket
23 Cover plate
25 Base plate
27 Cooling chamber
60 Screw compressor
61 Inlet opening
63 Outlet opening
64 Flange
70 Screw compressor
71 Inlet opening
73 Outlet opening
74 Flange
76 Oil sump housing
77 Oil lines
79 Recess
80 Screw compressor
81 Inlet opening
A Axis
B Line
C Line
D Line
84 Flange plate
85 Gear
86 Double arrow
89 Mating flange
90 Gearbox
91 Mounting wall
92 Bearing cover
93 Bearing ring
94 Drive shaft
95 Drive gear
97 Bearing seat
98 Double arrow

What is claimed is:

1. A multi-staged screw compressor system with a gearbox (90);

a drive gear (95) located in the gearbox;

and a first, second, and third screw compressor (60, 70, 80) that are fastened to the gearbox and coupled to the drive gear such that the first, second, and third screw compressors are all driven in common by the drive gear, wherein during operation the first screw compressor (60) compresses a flow of gaseous fluid from an inlet pressure to a first intermediate pressure, the second screw compressor (70) compresses the flow of fluid from the first intermediate pressure to a second intermediate pressure, and the third screw compressor compresses the flow of fluid from the second intermediate pressure to a final pressure, wherein the final pressure is at least thirty times the inlet pressure, and further wherein the gearbox (90) has a perpendicular mounting wall (91), a drive shaft (94) rotatably held on a horizontal axis in the gearbox and supporting the drive gear (95), and the first, second, and third screw compressors (60, 70, 80) are attached to the mounting wall (91) parallel with one another and cantilevered, each of the first, second, and third screw compressors having two screw rotors (3, 5) whose axes are parallel and which have screw-shaped ribs and grooves that mesh together and a shaft pin (7*c*) on one of the two screw rotors that extends through an opening in the mounting wall (91) into the gearbox (90) and that supports respective driven gears (65, 75, 85) that each mesh with the drive gear (95), wherein the driven gears (65, 75) of the first and second screw compressors mesh with the drive gear (95) at locations that are above the horizontal plane that runs through the rotating axis (A) of the drive gear and wherein the third screw compressor (80) is located below the first and the second screw compressors (60, 70) and the driven gear (85) of the third screw compressor meshes with the drive gear (95) at a location that is less than 30° with respect to the vertical plane running through the rotating axis (A) of the drive gear (95) from the lowest point (T) of the periphery of the drive gear (95).

2. The multi-staged screw compressor system according to claim 1, wherein the inlet pressure is approximately 1 bar, the first intermediate pressure is 2 to 6 bar, the second intermediate pressure is 10 to 15 bar, and the final pressure is 30 to 50 bar.

3. The multi-staged screw compressor system according to claim 1, wherein the first, second and third screw compressors (60, 70, 80) are each dry-running screw compressors.

4. The multi-staged screw compressor system according to claim 1, wherein a plane (C) passing through the rotating axis of the drive gear (95) and the driven gear (65) of the first screw compressor assumes an angle (a) of not more than 30° with respect to the horizontal plane (B-B) running through the rotating axis (A) of the drive gear (95).

5. The multi-staged screw compressor system according to claim 1, wherein a plane (C) passing through the rotating axis of the drive gear (95) and the driven gear (75) of the second screw compressor assumes an angle (13) of not more than 20° with respect to the horizontal plane (B-B) running through the rotating axis (A) of the drive gear (95).

6. The multi-staged screw compressor system according to claim 1, wherein a plane passing through the rotating axis of the drive gear (95) and the driven gear (85) of the third screw compressor assumes an angle ((Y)) of less than 20° with respect to the vertical plane running through the rotating axis (A) of the drive gear (95).

7. The multi-staged screw compressor system according to claim 1, wherein the drive shaft (94) supporting the drive gear (95) is held by exchangeable bearing parts (93, 97) that have differing eccentricities in the horizontal direction, such that by changing the exchangeable bearing parts, the position of the rotating axis of the drive shaft (94) in the gearbox (90) can be essentially shifted in the horizontal direction (98).

8. The multi-staged screw compressor system according to claim 7, wherein to change the RPM ratio of the first, second, and third screw compressors (60, 70, 80) of the compressor system, exchangeable gear sets are made available, each of which consists of an additional drive gear (95) and additional driven gears (65, 75, 85) of varying diameters together with additional associated bearing parts (93, 97) and flange parts (84) with which to adjust the position of the drive gear (95) in the horizontal direction (98) and the driven gear (85) of the third screw compressor in the vertical direction (86).

9. The multi-staged screw compressor system according to claim 1, wherein the third screw compressor (80) is attached to the mounting wall (91) by exchangeable flange parts (84) such that by changing the exchangeable flange parts (84) the position of the third screw compressor (80) can be changed essentially in the vertical direction (86) relative to the gearbox (91).

10. The multi-staged screw compressor system according to claim 9, wherein to change the RPM ratio of the first, second, and third screw compressors (60, 70, 80) of the compressor system, exchangeable gear sets are made available, each of which consists of an additional drive gear (95) and additional driven gears (65, 75, 85) of varying diameters together with additional associated bearing parts (93, 97) and flange parts (84) with which to adjust the position of the drive gear (95) in the horizontal direction (98) and the driven gear (85) of the third screw compressor in the vertical direction (86).

11. The multi-staged screw compressor system according to claim 1, wherein the first screw compressor (60) is designed to have an outlet pressure of 2 to 6 bar, the second screw compressor (70) of the second stage is designed to have an outlet pressure of 10 to 15 bar, and the third screw compressor (80) is designed to have an outlet pressure of 30 to 50 bar.

* * * * *

UNITED STATES PATENT AND TRADEMARK OFFICE

CERTIFICATE OF CORRECTION

PATENT NO. : 8,342,829 B2
APPLICATION NO. : 12/094390
DATED : January 1, 2013
INVENTOR(S) : Carsten Achtelik et al.

It is certified that error appears in the above-identified patent and that said Letters Patent is hereby corrected as shown below:

In the Claims:

Column 7, Line 4 of Claim 4: Replace "[(a)] with --(α)--

Column 7, Line 10 of Claim 5: Replace [(13)] with --(β)--

Signed and Sealed this
Twenty-eighth Day of May, 2013

Teresa Stanek Rea
*Acting Director of the United States Patent and Trademark Office*